United States Patent [19]

Bruno, III

[11] Patent Number: 5,069,696

[45] Date of Patent: Dec. 3, 1991

[54] SHOP VAC HAVING EXTERNAL EXHAUST FILTER

[76] Inventor: Anthony R. Bruno, III, 129 Valley Rd., Sewickley, Pa. 15143

[21] Appl. No.: 618,889

[22] Filed: Nov. 28, 1990

[51] Int. Cl.[5] ..... B01D 46/02

[52] U.S. Cl. ..... 55/476; 55/490; 55/498; 55/DIG. 3

[58] Field of Search ..... 55/315, 429, 385.1, 55/385.4, 467, 471, 498, 490, DIG. 3

[56] References Cited

U.S. PATENT DOCUMENTS

| | | | |
|---|---|---|---|
| 3,618,297 | 11/1971 | Hamrick | 55/DIG. 3 X |
| 3,853,517 | 12/1974 | Mitchell | 55/DIG. 3 X |
| 4,133,658 | 1/1979 | Callewyn | 55/DIG. 3 X |
| 4,314,831 | 2/1982 | Barbic | 55/498 X |

*Primary Examiner*—Charles Hart

*Attorney, Agent, or Firm*—Donald J. Breh

[57] ABSTRACT

A shop type vacuum cleaner including an externally mounted filter including a filter housing including a filter element and an elongated inlet tube slidably received within an exhaust outlet opening from the vacuum cleaner debris compartment.

4 Claims, 1 Drawing Sheet

SHOP VAC HAVING EXTERNAL EXHAUST FILTER

BACKGROUND OF THE INVENTION

This invention relates to vacuum cleaners and more particularly to shop type vacuum cleaners. In still greater particularity, the invention relates to a shop type vacuum having an externally mounted exhaust filter.

Shop type vacuum cleaners typically include a motor operated blower for creating a negative pressure providing for suction of debris into a compartment. The debris sucked into the device is deposited within the compartment and the air is exhausted through an exhaust outlet. Although shop type vacuum cleaners are effective in collecting relatively large and heavier particles, it is not uncommon for some smaller and lighter particles to be contained in the exhaust air. The introduction of such small particles into the atmosphere is environmentally undesirable especially since the shop type vacuums are typically used in closed or not well ventilated locations.

Filters to help filter out these smaller particles which escape containment are known and include both external and internally mounted devices. Internally mounted filters such as that disclosed in U.S. Pat. No. 4,072,483, require at least partial dissembly of the vacuum cleaner to remove, clean or replace the filter element which is not desirable because opening of the compartment disturbs the accumulated debris and allows particles to escape directly into the atmosphere.

On the other hand, external filters such as that disclosed in U.S. Pat. No. 4,613,348, while effective in removing smaller particles that escape containment, are rather large and bulky and are separately located units requiring additional piping or hoses for connection to the vacuum cleaner exhaust.

Accordingly, it is the object of the present invention to provide for a filter device for use with a shop type vacuum cleaner that effectively traps and removes small particles from the exhaust of the vacuum cleaner and which is easily serviced by eliminating the need to disassemble or otherwise expose the debris compartment and which does not require separate hoses and piping.

SUMMARY OF THE INVENTION

According to the invention, there is provided a shop type vacuum cleaner having an externally mounted exhaust filter wherein the exhaust filter includes a housing having a filter element mounted in the housing and an elongated inlet tube mounted in the exhaust outlet from the vacuum cleaner.

According to an important feature of the invention, the inlet tube is an elongated stepped tube slidably received within a circular exhaust opening from the vacuum cleaner.

According to another important feature of the invention, there is provided a plurality of inlet tube adapter members each adapted to be received in a different size outlet from the vacuum cleaner for mounting the filter element to different vacuum cleaner styles.

According to a preferred embodiment, the filter includes a cylindrical canister having a perforated side wall, an inlet in the bottom wall with the cylindrical filter element surrounding the inlet and positioned adjacent the perforated side wall. The elongated inlet tube extends from the bottom wall communicates with the inlet and is slidably received in an exhaust outlet from the vacuum cleaner.

BRIEF DESCRIPTION OF THE DRAWINGS

The invention will be better understood after reading the following Detailed Description of the Preferred Embodiment in conjunction with the drawings in which.

DETAILED DESCRIPTION OF THE PREFERRED EMBODIMENT

Figure 1:
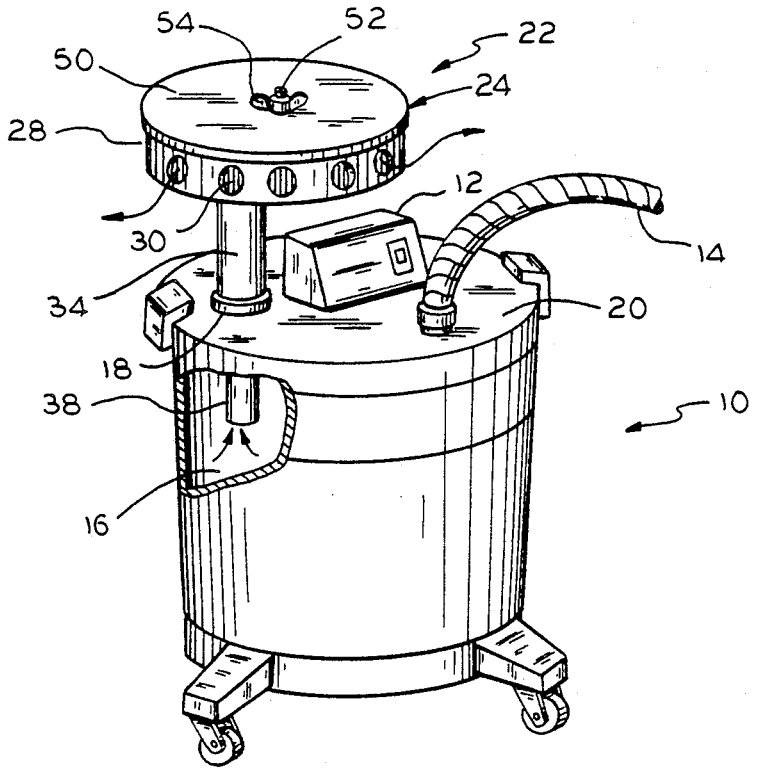
FIG. 1 is a pictorial view with a cut a way portion of a shop-type vacuum cleaner including an externally mounted filter according to the invention.

Shown in FIG. 1, is a typical shop-type vacuum cleaner 10, having a motor operated blower 12, for creating a suction at an inlet hose through which debris is sucked and deposited within an internal debris compartment 16, within the vacuum cleaner. The vacuum cleaner is provided with an exhaust outlet 18, usually in the form of a circular aperture in a top cover 20, of the vacuum cleaner from which air is exhausted after the debris is deposited in the compartment. In the absence of some type of filtering arrangement, smaller light weight particles are typically carried with the exhausted air to the atmosphere which is undesirable.

Figure 2:
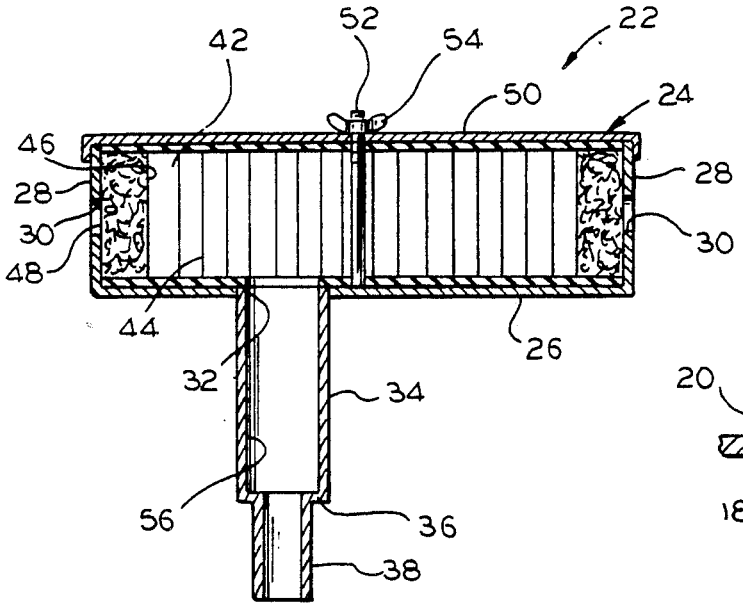
FIG. 2 is a vertical cross sectional view through a preferred embodiment of the filter of FIG. 1 showing details of construction.
Figure 3:
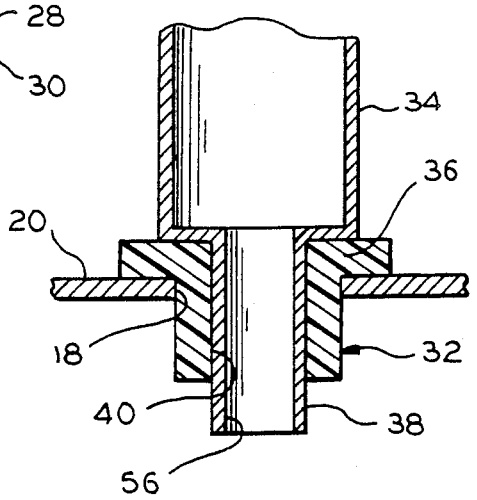
FIG. 3 is an enlarged partial cross-sectional view of the lower most portion of the inlet tube of the filter in FIG. 1 showing an alternative mounting to the exhaust outlet from the vacuum cleaner.

As shown in FIG. 1, an exhaust filtering device 22, is removably mounted directly in the exhaust outlet for removing such exhausted particles. According to a preferred embodiment, the filter device 22, includes a circular housing 24, or canister having a bottom wall 26, and an upstanding peripheral side wall 28 which is provided with a plurality of perforations 30. The bottom wall 26 includes an inlet hole 32 at which an elongated cylindrical inlet pipe or tube 34 is attached. As shown in FIGS. 2 and 3, the inlet tube is preferably stepped so as to form an annular shoulder 36 exceeding the diameter of the exhaust outlet hole 18 in the lid of the vacuum cleaner. The filter 22 is mounted to the vacuum cleaner by inserting the small diameter portion 38 of the inlet tube through the exhaust opening 18 in the vacuum cleaner with the shoulder 36 resting around the periphery of the exhaust outlet.

As shown in FIG. 3, not all exhaust outlets of all the types of shop-type vacuum cleaners may be provided with the same diameter exhaust outlet. Accordingly, there is provided a plurality of adapters 37, each having different outside diameters corresponding to different diameters of exhaust openings 18 in different vacuum cleaners. The adapters are all provided with a through hole 40 of the same size as the lower most portion 38 of the inlet tube as shown in FIG. 3. Accordingly, the filter device can be used with vacuum cleaners of different makes which may have different size exhaust openings.

As shown in FIG. 2, a filter element 42 is disposed within an internal cavity 44 of the filter housing and surrounds the inlet 32. An inlet side 46 of the filter element is exposed to the inlet hole 32 into the filter cavity and the outlet side 48 of the filter element is exposed to the perforated side wall 28 providing for exhausting of the filtered air through the perforations 30. The filter cover or lid 50 closes the filter cavity and is retained to the side wall by a stud 52 and wing nut 54.

In use, as noted above, the small diameter portion 38 of the inlet tube, either alone or in combination with an appropriate adapter 37, is inserted into the exhaust outlet from the vacuum cleaner and exhausted air carrying the debris not deposited within the debris compartment 16 of the vacuum cleaner is carried through the inlet tube passage 56 into the filter cavity 44, passes through the filter element 42 where the fine debris is removed and the air is exhausted from the filter by way of the perforations 30 in the side wall 28.

When the filter element requires changing, there is no need to disassemble the vacuum cleaner but, rather the cover 50 only need be removed to gain access to the filter element for replacement or cleaning. Many types of filter elements can be utilized, including for example, open cell foams and pleated and treated paper elements as found in automotive type applications.

Having described the preferred embodiment, those skilled in the art, having the benefit of this description and the accompanying drawings can readily devise other embodiments and modifications and such other embodiments and modifications are to be considered to be within the scope of the appended claims.

What is claimed is:

1. A shop type vacuum cleaner including an externally mounted filter comprising in combination:

a shop type vacuum cleaner of the type having an exhaust outlet from an internal compartment in which debris is collected;

an exhaust filter mounted to the vacuum cleaner at said exhaust outlet, said exhaust filter including a filter housing having an inlet communicating with a filter element in the housing and an elongated inlet tube having an inlet passage communicating with the inlet and;

adapter means for adapting said inlet tube for receipt in different size exhaust outlets of the vacuum cleaner.

2. The combination shop type vacuum cleaner and exhaust filter as defined in claim 1 including at least one inlet adapter member including an opening sized to slidable receive said inlet tube, said at least one inlet tube adapter member adapted to be received in a different size exhaust outlet associated with different shop vacuum cleaners.

3. The combination shop type vacuum cleaner and exhaust filter as defined in claim 1 wherein said inlet tube is externally stepped having a smaller diameter portion at a free end.

4. A shop type vacuum cleaner including an externally mounted exhaust filter comprising in combination:

a shop type vacuum cleaner of the type having an exhaust outlet from an internal debris collection compartment; and a filter including a housing having a bottom wall, a perforated side wall around a peripheral edge of the bottom wall defining a filter outlet, a cover removable mounted to said side wall defining an internal filter cavity, an inlet opening in the bottom wall opening into said filter cavity, a filter element in the filter cavity surrounding said opening into said filter cavity, an entrance side of the filter element exposed to said inlet opening into said cavity, an exit side of the filter element exposed to said outlet perforations in the side wall and an elongated inlet tube mounted to the bottom wall of the filter housing and communicating with said inlet opening into said filter cavity, said inlet tube slidable received in said exhaust outlet from said debris compartment.

* * * * *